US006993275B2

(12) United States Patent
Mitsuya et al.

(10) Patent No.: US 6,993,275 B2
(45) Date of Patent: Jan. 31, 2006

(54) IMAGE POSITION DETECTING METHOD

(75) Inventors: Teruaki Mitsuya, Hitachinaka (JP); Hiroyuki Mabuchi, Hitachinaka (JP); Toru Miyasaka, Tsuchiura (JP); Mieko Ishii, Tsuchiura (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 69 days.

(21) Appl. No.: 10/796,208

(22) Filed: Mar. 10, 2004

(65) Prior Publication Data

US 2004/0179870 A1 Sep. 16, 2004

(30) Foreign Application Priority Data

Mar. 11, 2003 (JP) ..... 2003-064526

(51) Int. Cl.
*G03G 15/01* (2006.01)

(52) U.S. Cl. ..... 399/301; 399/394; 347/116

(58) Field of Classification Search ..... 399/301, 399/394; 347/116

See application file for complete search history.

(56) References Cited

U.S. PATENT DOCUMENTS

| | | | | |
|---|---|---|---|---|
| 4,916,547 A | | 4/1990 | Katsumata et al. | |
| 5,287,162 A | | 2/1994 | de Jong et al. | |
| 5,631,686 A | | 5/1997 | Castelli et al. | |
| 6,021,258 A | | 2/2000 | Ishizu et al. | |
| 6,275,244 B1 | * | 8/2001 | Omelchenko et al. | 346/116 |
| 6,300,968 B1 | * | 10/2001 | Kerxhalli et al. | 347/116 |
| 6,903,758 B1 | * | 6/2005 | Kerxhalli et al. | 347/116 |

OTHER PUBLICATIONS

German Office Action dated May 31, 2005 with an English language translation.

* cited by examiner

*Primary Examiner*—Christopher W. Fulton
*Assistant Examiner*—Tania Courson
(74) *Attorney, Agent, or Firm*—McGuireWoods LLP

(57) ABSTRACT

In an electrophotographic recording device, a multicolor toner image is formed by images in each color superimposed on one another. In order to detect image misalignment, image-forming units form a color registration detection pattern, and sensors detect the pattern and output detection signals. A control unit detects the position of the patterns based on only portions of the detection signals corresponding to leading edges of the patterns.

17 Claims, 8 Drawing Sheets

IMAGE POSITION DETECTING METHOD

BACKGROUND OF THE INVENTION

1. Field of the Invention

The present invention relates to a detection method for detecting a position of an image formed by a tandem color recording device having an electrophotographic system.

2. Related Art

A recording device having an electrophotographic system performs charging, exposing, developing, and transferring steps to form a color image on the surface of a recording sheet by using color particles and a fixing step to fix the color image on the recording sheet. Toner that is powder for electrophotograph is used as the color particles.

In the charging step, the entire surface of a photosensitive member is charged. In the subsequent exposing step, areas on the photosensitive member are exposed to light to remove the charge therefrom. These steps generate a contrast in potential between the charged areas and discharged areas on the surface of the photosensitive member, thereby forming an electrostatic latent image.

Next in the developing step, toner particles are charged, and the electrostatic latent image is developed using the charged toner particles. Methods for charging toner include dual-component development in which carrier beads are used and single-component development in which the toner particles are tribocharged by friction generated between the toner particles and components of the recording device. A method called bias development is widely used for developing electrostatic latent images.

In the bias development, a bias voltage is applied to a developing roller. Through the effect of an electric field generated between the developing roller and the electrostatic potential developed on the surface of the photosensitive member, the charged toner particles are separated from developer (a mixture of toner particles and carrier beads) on the surface of the developing roller and are transferred onto the electrostatic latent image formed is on the surface of the photosensitive member, thereby forming a visible image.

A latent image potential, that is, the potential of the electrostatic latent image, may be a charge potential or the discharge potential described above. Generally, the method using the charge potential as the latent image potential is called normal development, while the method employing the discharge potential is called reverse development. The charge potential or discharge potential not being used as the latent image potential is called background potential. The bias potential of the developing roller is set between the charge potential and the discharge potential, and the difference between the bias potential and the latent image potential is called developing potential differential. Similarly, the difference between the bias potential and the background potential is called background potential differential.

A background potential differential that is too large tends to generate thin spots and defects on the trailing edge of the image in relation to the rotational direction of the developing roller. In addition to the background potential differential, deterioration of the developer and irregularities in other developing conditions may also lead to such thin spots and defects in the trailing edge of the image.

An electrophotographic device capable of recording multicolor images, such as a tandem color electrophotographic device, uses a plurality of image-forming units to form an image for each color (separated color). Multicolor images are formed by superimposing the plurality of images in each color, transferred onto a recording medium, and fixed on the recording medium.

However, misalignment in the transferred images may be caused by irregularities in the various mechanical systems of the tandem color recording device, such as eccentricity of the photosensitive member, positional or pitch deviation in the mounting positions of the exposure devices, speed variations between the plurality of photosensitive members, and skew or speed fluctuations in the transfer belt. Such a misalignment in the transferred images causes image misalignment. Alignment errors in the electrostatic latent images may result from irregularities in the surface of the polygon mirror provided in the exposure device and the like, which in turn may also cause image misalignment.

U.S. Pat. No. 5,287,162 proposes a technology for preventing this type of image misalignment (color registration errors). According to this technology, each image-forming unit is used to form a color registration detection pattern (patch in chevron shape) in each separated color on the surface of an intermediate transfer member. Photoreceptors detect the position of the detection patterns. Then, image misalignment is corrected based on detection signal from the photoreceptors.

SUMMARY OF THE INVENTION

However, U.S. Pat. No. 5,287,162 does not describe in detail what type of processing is performed on the detection signals from the photoreceptors to detect the position of the pattern.

In view of the foregoing, it is an object of the present invention to provide an image position detecting method that is accurate.

It is another object of the present invention to provide a high-quality color recording device capable of sustaining good color image formation quality by maintaining precise color registration.

In order to attain the above and other objects, according to one aspect of the present invention, there is provided a detecting method for detecting a position of an image. The detecting method includes a) forming an image on a medium, the image having a leading edge facing a transport direction and a tailing edge opposite to the leading edge, b) detecting the image on the medium using a detecting unit while transporting the medium in the transport direction relative to the detecting unit, the detecting unit outputting a detection signal, wherein the detection signal has a first portion corresponding to the leading edge of the image and a second portion corresponding to the tailing edge of the image, and c) detecting a position of the image based only on the first portion of the detection signal.

There is also provided an electrophotographic recording device that forms multicolor images by superimposing a plurality of images in each of a plurality of colors one on the other, The electrophotographic recording device includes a conveying unit that conveys a medium in a conveying direction, an image forming unit that forms a predetermined test image on the medium, a first detecting unit that detects the predetermined test image on the medium, the first detecting unit outputting a detection signal, and a second detecting unit that detects a position of the predetermined test image on the medium based on the detection signal from the first detecting unit. The predetermined test image has a leading edge facing the conveying direction and a tailing edge opposite to the leading edge. The detection signal includes a first portion corresponding to the leading edge and a second portion corresponding to the tailing edge. The second detecting unit detects the position of the predetermined test image based only on the first portion of the detection signal.

BRIEF DESCRIPTION OF THE DRAWINGS

In the drawings:

FIG. 6(*b*) shows a waveform which is generated from the waveforms of FIG. 6(*a*) and based on which a position of the patch is detected according to a comparative example;

FIG. 7(*b*) shows delayed and inverted waveforms generated from the waveforms of FIG. 7(*a*);

FIG. 7(*c*) shows a superimposed waveform which is generated from the waveforms of FIG. 7(*b*) and based on which a position of the patch is detected according to the first embodiment of the present invention;

FIG. 9(*b*) shows an inverted waveform and a delayed waveform generated from the waveforms of FIG. 9(*a*);

FIG. 9(*c*) shows a waveform which is generated from the waveforms of FIG. 9(*b*) and based on which a position of the patch is detected according to the second embodiment;

FIG. 11(*b*) shows an inverted waveform and a delayed waveform generated from the waveforms of FIG. 11(*a*); and FIG. 11(*c*) shows a waveform which is generated from the waveforms of FIG. 11(*b*) and based on which a position of the patch is detected according to the third embodiment.

DESCRIPTION OF THE PREFERRED EMBODIMENTS

An image position detecting method and an electrophotographic recording device according to a first embodiment of the present invention will be described with reference to FIGS. 1 to 6. In this embodiment, a tandem color recording device 100 shown in FIG. 1 is taken as an example of the electrophotographic recording device of the present invention.

Figure 1:
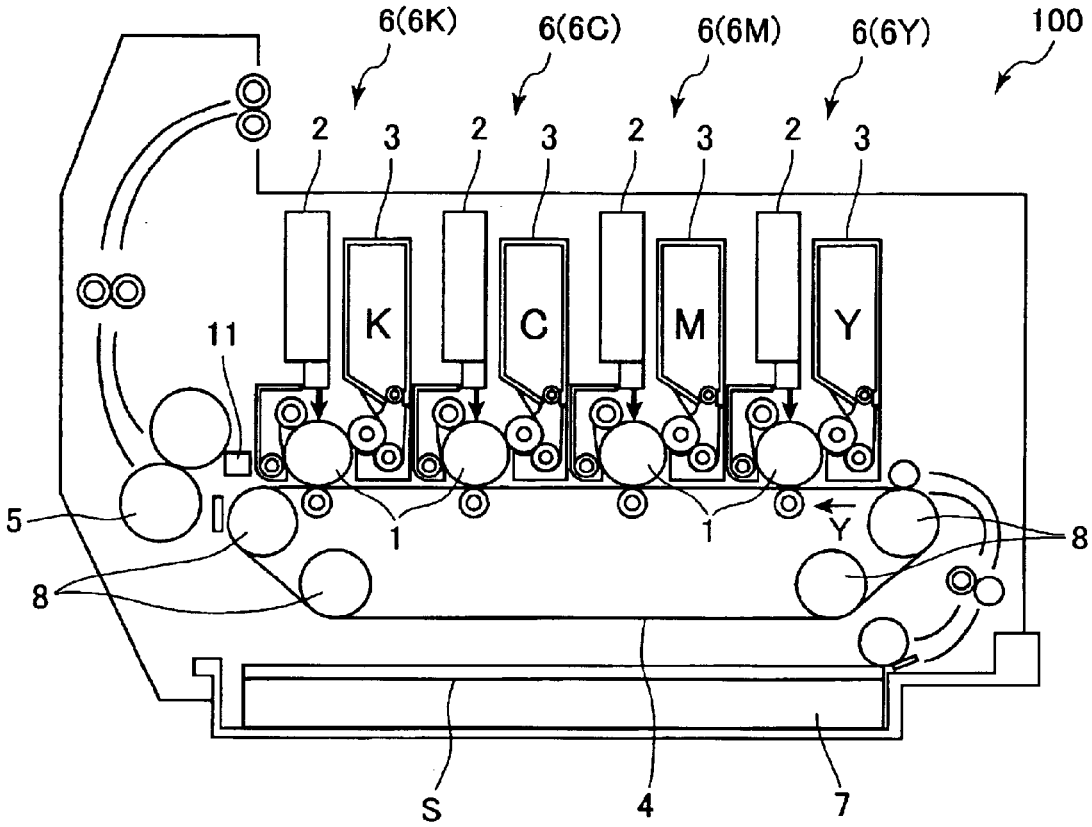
FIG. 1 is a side cross-sectional view of a tandem color recording device according to a first embodiment of the present invention.

As shown in FIG. 1, the tandem color recording device 100 includes a sheet-supply unit 7, a transfer belt 4, a plurality of feed rollers 8, a plurality of image-forming units 6 (6K, 6C, 6M, 6Y), and a fixing unit 5.

The sheet supply unit 7 stores a stack of recording sheets S and supplies the recording sheets S one at a time onto the transfer belt 4. The transfer belt 4 is wound around the feed rollers 8 and rotates in a sub-scanning direction Y as the rollers 8 are driven to rotate, thereby transporting the recording sheet S in the sub-scanning direction Y.

The image-forming units 6 are arranged in the sub-scanning direction Y. Each of the image forming units 6 corresponds to one of a plurality of colors (separated colors) cyan (C), magenta (M), yellow (Y), and black (K). Each image-forming unit 6 includes a photosensitive member 1, an exposure device 2, a charging device (not shown), a developing device 3, a cleaning device (not shown), and other components. The exposure device 2, the charging device, the developing device 3, and the like are positioned around the corresponding photosensitive member 1. The exposure device 2 is for forming an electrostatic latent image on the photosensitive drum 1. The developing device 3 contains toner in one of the CMYK colors and supplies the toner onto the photosensitive member 1 to develop the electrostatic latent image into a toner image. The fixing unit 5 is for fixing a toner image onto the recording sheet S.

Figure 2:
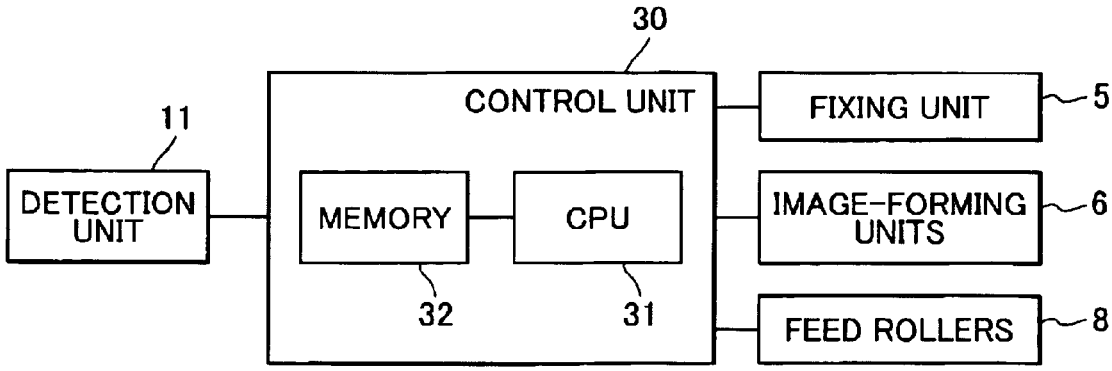
FIG. 2 is a block diagram of the tandem color recording device of FIG. 1.

As shown in FIG. 2, the tandem color recording device 100 further includes a detection unit 11 and a control unit 30. Detail of the detection unit 11 will be described later. The control unit 30 includes a central processing unit (CPU) 31 and a memory 32 and controls the overall operations of the tandem color recording device 100.

With this configuration, an image forming operation is performed according to the following steps. First, the charging device of each image-forming unit 6 applies a uniform charge over the surface of the corresponding photosensitive member 1. Next, an electrostatic latent image is formed sequentially on each photosensitive member 1 by the corresponding exposure device 2. The developing devices 3 develop the electrostatic latent images to form toner images in each of the CMYK colors. Then, the toner images in each of the four colors are sequentially transferred to and superimposed on a recording sheet S that is being transported in the sub-scanning direction Y on the transfer belt 4, thereby forming a multicolor toner image on the recording sheet S. Subsequently, the fixing unit 5 fixes the multicolor toner image onto the recording sheet S, and the recording sheet S with the toner image fixed thereon is discharged, completing the image forming process.

However, misalignments in the transfer positions of the toner images on a recording sheet S can occur due to errors in the mechanical systems of the tandem color recording device 100, such as eccentricity of the photosensitive members 1, errors in the mounting positions of the exposure devices 2, variations in pitch between the exposure devices 2, speed variations among the photosensitive members 1, skew in the transfer belt 4, and speed fluctuations in the transfer belt 4. Also, misalignment of the electrostatic latent images can occur due to irregularities in the surface of a polygon mirror (not shown) disposed in each exposure device 2 and the like. Both the misalignment in the transfer positions and the misalignment of the electrostatic latent images cause color registration errors (image misalignment) in toner images.

In order to correct such color registration errors, a color registration correcting operation is performed in the tandem color recording device 100. The color registration correcting operation according to the first embodiment will be described in detail.

Figure 3:
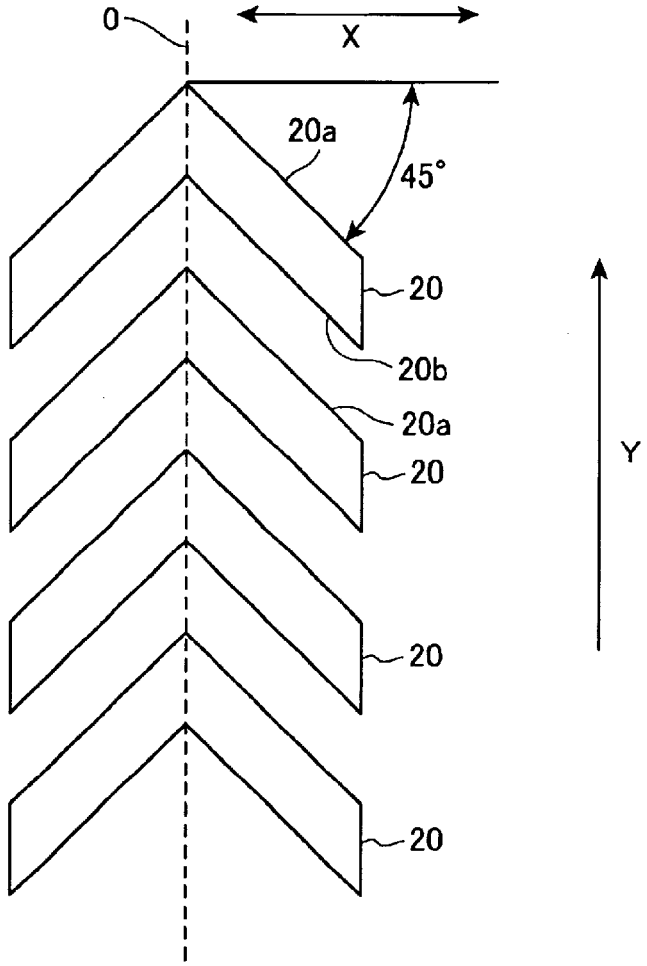
FIG. 3 is an explanatory diagram showing patches that are used for detecting position registration errors.

First, color registration detection patterns in each separated color are formed on the transfer belt 4 at prescribed intervals. In the present embodiment, patches 20 shown in FIG. 3 are formed as the color registration detection patterns. Each patch 20 is formed in a chevron shape with one of the separated colors CMYK so as to be symmetrical about a centerline 0 that extends parallel to the sub-scanning direction Y. The patch 20 has a leading edge 20*a* facing the sub-scanning direction Y and a tailing edge 20*b* opposite to the leading edge 20*a*. The leading edge 20*a* is at an angle of 45° with respect to a main-scanning direction X perpendicular to the sub-scanning direction Y.

While the patches 20 of each color are formed at the prescribed intervals, the irregularities described above may cause image misalignments. Magnitudes of these misalignments are detected in the following manner.

Figure 5:
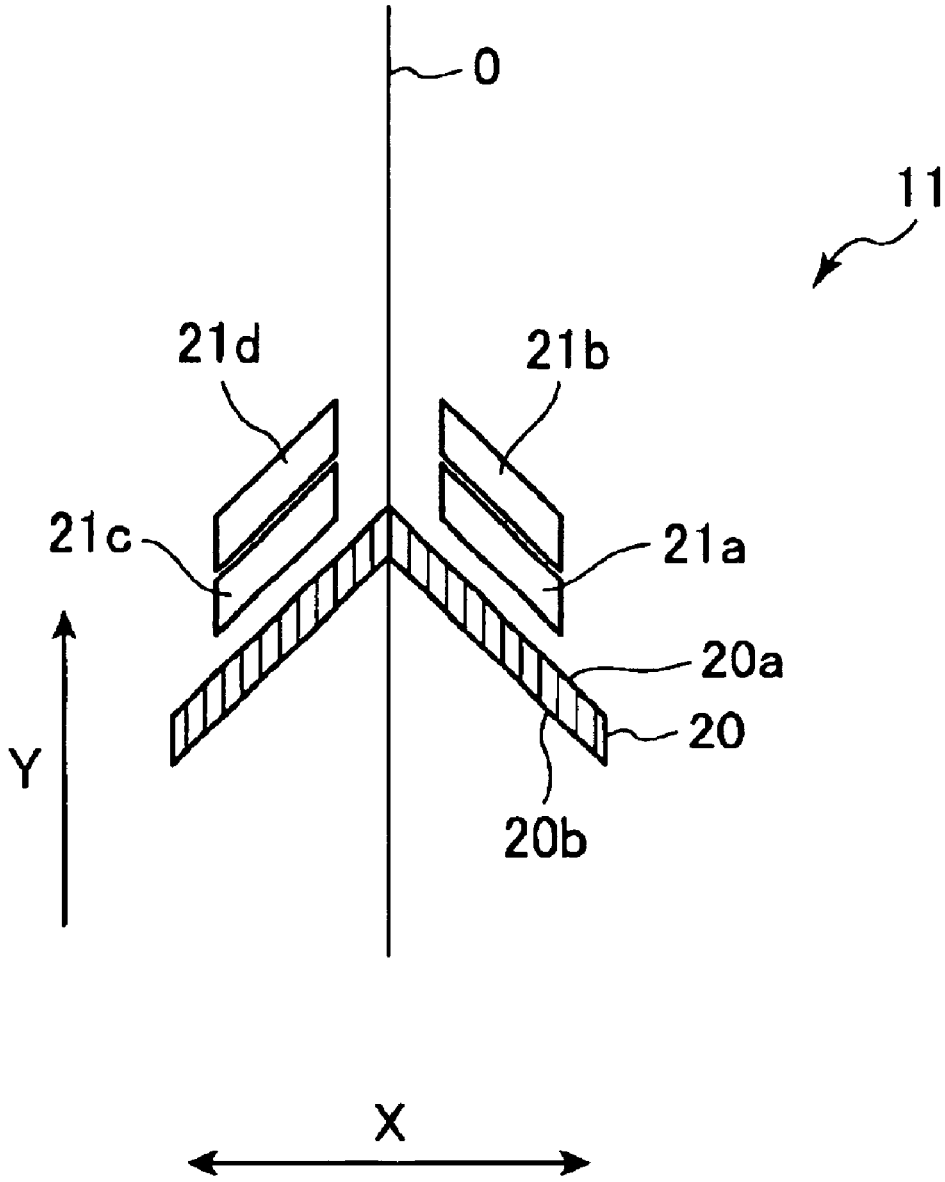
FIG. 5 is an explanatory diagram showing the positional relationship of the patch to sensors of the detection unit.

That is, these patches 20 are detected by the detection unit 11 shown in FIG. 1. As shown in FIG. 5, the detection unit 11 includes four sensors 21 (21*a*, 21*b*, 21*c*, and 21*d*) disposed symmetrically on the sides of the centerline 0. The sensors 21*a* and 21*b* are on one side of the centerline 0, and the detection units 21*c* and 21*d* are on another side of the centerline 0.

Figure 4:
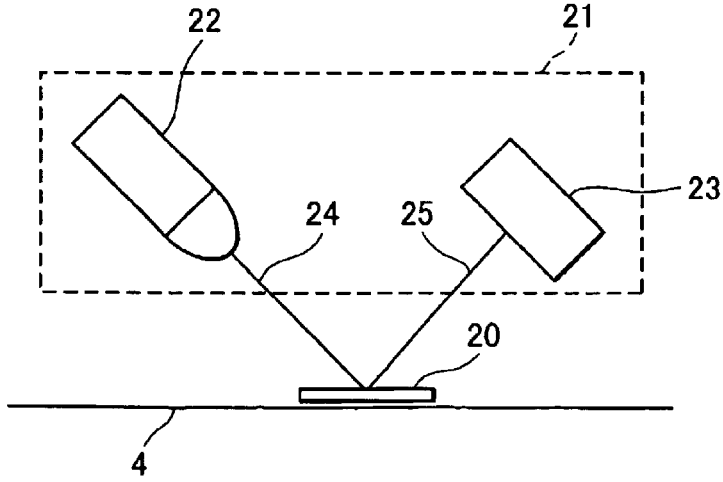
FIG. 4 is an explanatory diagram of a sensor of a detection unit of the tandem color recording device.

As shown in FIG. 4, each sensor 21 is a photoreceptor including a light-emitting element 22, such a light-emitting diode, and a light-receiving element 23, such as a photosensor.

Referring back to FIG. 5, each sensor 21*a*–21*d* is disposed with parallel to the leading edge 20*a* of the chevron patch 20. The light-detecting range of the sensor 21*a*–21*d* is substantially equivalent to the width of the patch 20 in the sub-scanning direction Y.

Figure 6A:
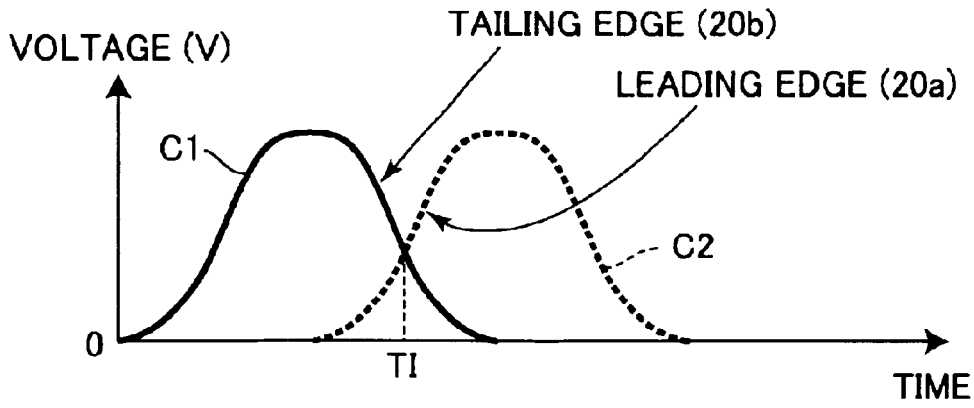
FIG. 6(*a*) shows waveforms of detection signals from the detection unit.
Figure 6B:
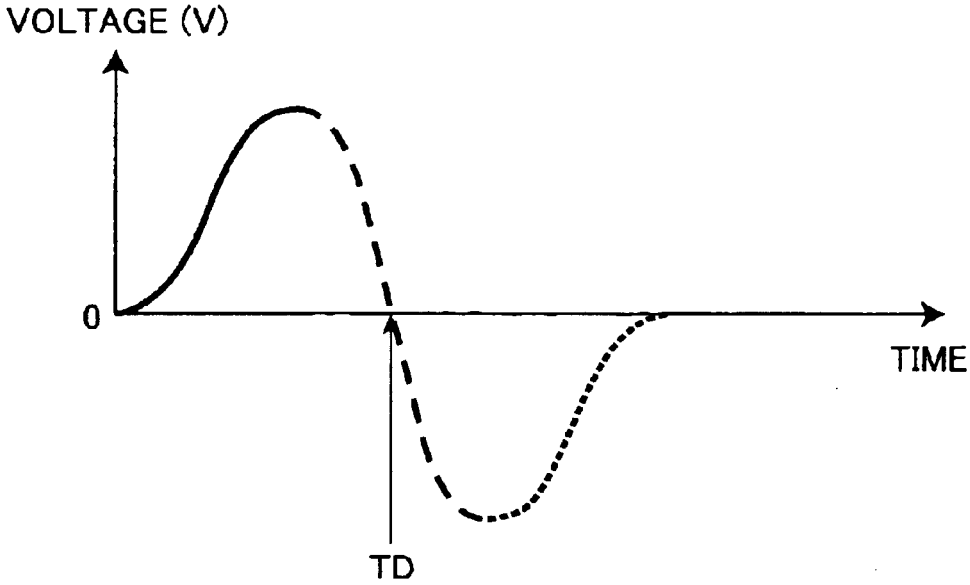

With this configuration, each patch 20 on the transfer belt 4 is detected by the sensors 21*a*–21*d* when passing beneath the sensors 21. Specifically, as shown in FIG. 4, the light-emitting element 22 of each sensor 21*a*–21*d* emits an irradiated light 24 toward the transfer belt 4 at a position through which the patches 20 pass. When the irradiated light 24 strikes the patch 20, a reflected light 25 is received by the light-receiving element 23. The light-receiving element 23 outputs a detection signal to the control unit 30 via a signal wire. Because the light-detecting range of the sensor 21*a*–21*d* is equivalent to the width of the patch 20, the detection signal from the light receiving element 25 of each sensor 21*a*–21*d* always fluctuates as shown in FIG. 6(*a*). Note that waveforms C1 and C2 in FIG. 6(*a*) are of the detection signals from the sensors 21*a* or 21*c* and 21*b* or 21*d*, respectively for a single patch 20. In other words, the detection signal from each of the sensors 21*a*–21*d* is shaped substantially like half a sine wave.

A rising slope in the front half of the waveform C1, C2 corresponds to the leading edge 20*a* of a patch 20, and a downward slope in the back half of the waveform C1, C2 corresponds to the trailing edge 20*b* of the patch 20. Note that the two sensors 21*a* and 21*b* are arranged so that the waveforms C1 and C2 of these sensors 21*a* and 21*b* partially overlap as shown in FIG. 6(*a*) The same is true for the sensors 21*c* and 21*d*.

Based on the waveforms C1 and C2, the CPU 31 calculates the position of the patch 20 in a manner described later. Here, in order to facilitate understanding of the present embodiment, a method for detecting the position of the patch 20 according to a comparative example will be described before describing the method according to the first embodiment of the present invention.

In this comparative example, the CPU 31 superimposes the waveform C2 on the waveform C1 by subtracting the waveform C2 from the waveform C1, thereby generating a waveform C3 shown in FIG. 6(*b*). That is, because the waveforms C1 and C2 partially overlap as shown in FIG. 6(*a*), by subtracting the waveform C2 from the waveform C1, the resultant waveform C3 passes through zero at a point TD, but does not levels off at zero for any length of time as shown in FIG. 6(*b*). In this manner, the occurrence of dead zones during detection is eliminated. The point TD at which the waveform C3 passes through zero indicates a position of the patch 20, i.e., the passage time of the patch 20.

In other words, a point TI (FIG. 6(*a*)) at which the waveform C1 intersects the waveform C2 is determined to be the position of the patch 20.

However, as described above, thin spots and defects may occur in a tailing edge of images, including the patches 20. Changes in developing characteristics over time, such as the occurrence of trailing edge defects, also change image characteristics in the trailing edge 20*b* of the patch 20. Because in this comparative example, the back half of the waveform C1 corresponding to the tailing edge 20*b* of the patch 20 overlaps with the front half of the waveform C2 corresponding to the leading edge of the patch 20, the position at which the waveform C3 reaches zero also changes over time. Further, when the toner degrades, defects in the trailing edge 20*b* exhibit unstable behavior, and the degree of defects differs among images. As a result, the identified position for each patch 20 differs, greatly reducing accuracy in detecting patch positions. In this manner, defects and thin spots in the trailing edge 20*b* of the patch 20 affects accuracy in detecting the position of the patch 20, and the accuracy in detecting image positions declines over time. This in turn affects accuracy in correction of color registration errors, resulting in a declining color image quality.

In view of foregoing, according to the first embodiment of the present invention, the position of each patch 20 is detected in the following manner.

Figure 7A:
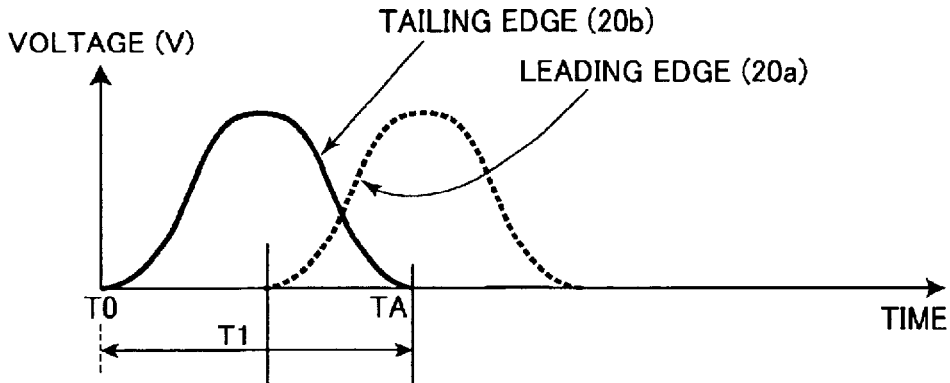
FIG. 7(*a*) shows waveforms of detection signals from the detection unit.
Figure 7B:
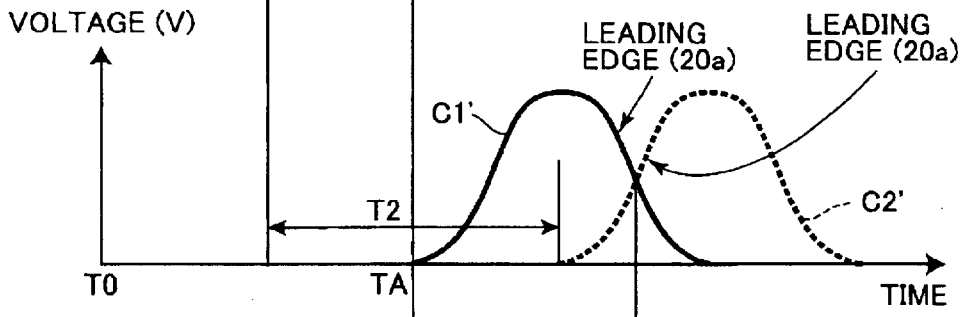
Figure 7C:
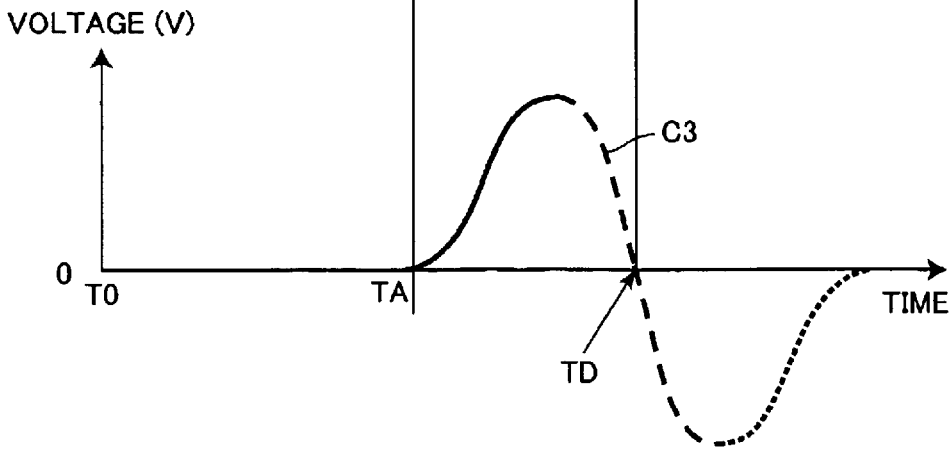

The waveforms C1 and C2 shown in FIG. 7(*a*) which are identical to those of FIG. 6(*a*) are obtained in the same manner as that in the above-described comparative example.

In FIG. 7(*a*), T0 indicates a timing at which the patch 20 reaches the sensor 21*a*. At timing TA, i.e., when a time T1 elapses after the timing T0, the patch 20 passes the sensor 21*a*, and the voltage of the detection signal from the sensor 21*a* reaches zero. The CPU 31 sequentially stores the waveform C1 of the detection signal from the sensor 21*a* into the memory 32.

At the timing TA, the CPU 31 stops storing the waveform C1 into the memory 32 and begins outputting the waveform C1 stored in the memory 32 in reverse order of time. That is, the waveform C1 is reversed in the front-to-back direction, thereby generating a delayed reverse waveform C1' shown in FIG. 7(*b*). Here, the timing TA is determined in advance, and the CPU 31 stops storing the waveform C1 into the memory 31 and begins outputting the waveform C1' based on the timing A and not based on the detection signal itself. The delayed reverse waveform C1' is delayed by the time T1 from the waveform C1.

On the other hand, the waveform C2 of the detection signal from the sensor 21*b* is temporarily stored in the memory 32, and subsequently outputted as a waveform C2' after a prescribed delay time T2. Alternatively, the waveform C2 could be passed through a delay circuit (not shown) for delaying the waveform C2' by the prescribed time delay T2. The time T1 is substantially equal to the delay time T2.

The CPU 31 superimposes the waveform C2' on the waveform C1' by subtracting the waveform C2' from the waveform C1' so as to generate a waveform C3 shown in FIG. 7(*c*) (that is, the CPU 31 sequentially subtracts the voltage value of the detection signal from the sensor 21*b* from the voltage value of the detection signal from the sensor 21*a*), and detects a timing TD at which the waveform C3 reaches zero. This timing T0 indicates a position of the patch 20. In this manner, the position of the patch 20 is detected.

As described above, according to the present embodiment, the position of the patch 20 is detected based only on a portion of the waveform C3 that corresponds to the leading edge 20*a* of the patch 20. Therefore, the position of the patch 20 can be detected accurately at all times regardless of unstable factors, such as defects and the like in the trailing edge 20*b* of the patch 20.

The same operation is performed for detection signals from the sensors 21*c* and 21*d*. That is, position of each patch 20 is detected by the sensors 21*a*, 21*b* and also by the sensors 21*c*, 21*d*, providing two sets of data on the position of each patch 20.

Based on data on the position of the patches 20, magnitudes of image misalignment are calculated in the following manner.

The magnitude of image misalignment among the patches 20 with respect to the sub-scanning direction Y is calculated by measuring the time differential (distance) between the positions of the adjacent patches 20 and comparing these measurements with a predetermined reference time (optimal time).

The magnitude of image misalignment with respect to the main scanning direction X is calculated for each patch 20. That is, a position of a patch 20 detected based on the detection signals from the sensors 21*a* and 21*b* is compared to a position of the same patch 20 detected based on the detection signals from the sensors 21*c* and 21*d*. Then, a time interval of these two detected positions indicates the magnitude of the misalignment of the patch 20. The time interval of the detected positions could be measured by using an external counter.

Because the magnitudes of image misalignment with respect to both the main and sub scanning directions X and Y are detected by using the same detection unit 21, color registration errors can be detected quickly.

Then, based on the calculated magnitudes of image misalignment, the CPU 31 calculates errors in color registration, magnification, skew, and the like, and further controls the timing at which the exposure devices 2 begin forming electrostatic latent images, the speed and angle of the polygon motor and skew motor (not shown), and the like so as to prevent the color registration errors.

Figure 8:
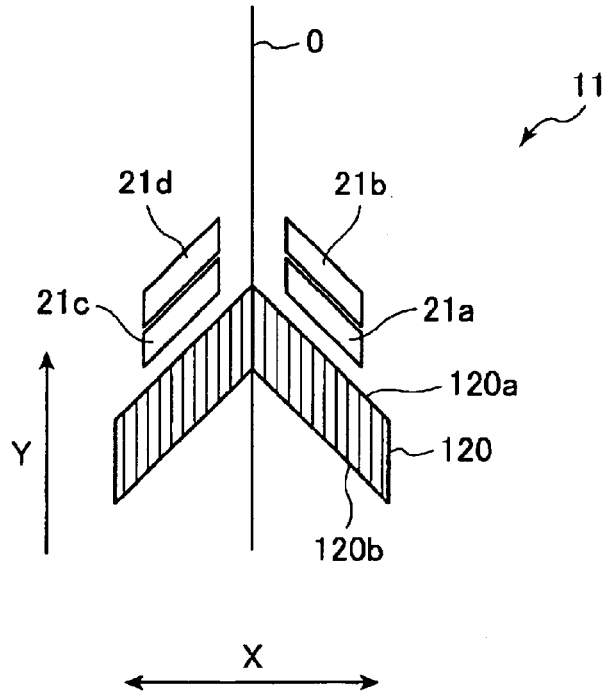
FIG. 8 is an explanatory diagram showing the positional relationship of a patch and the sensors of the detection unit according to a second embodiment.
Figure 9A:
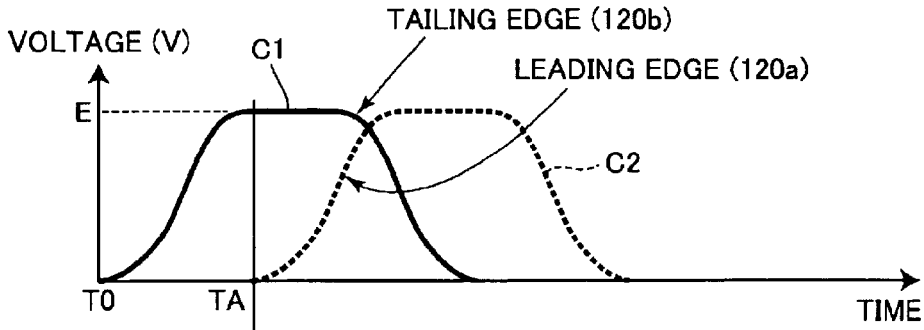
FIG. 9(*a*) shows waveforms of detection signals from the detection unit according to the second embodiment.
Figure 9B:
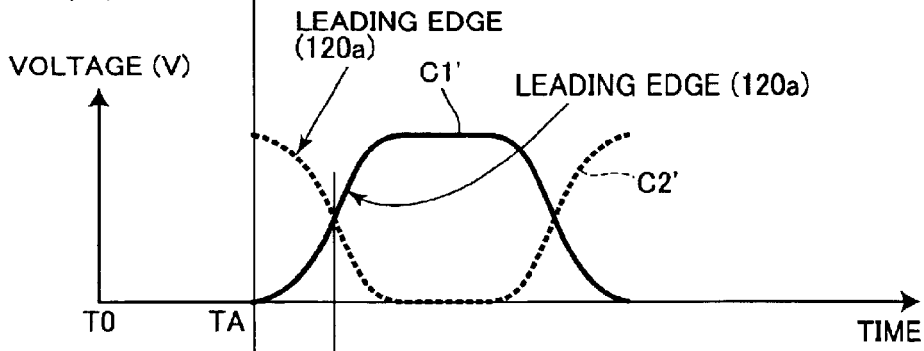
Figure 9C:
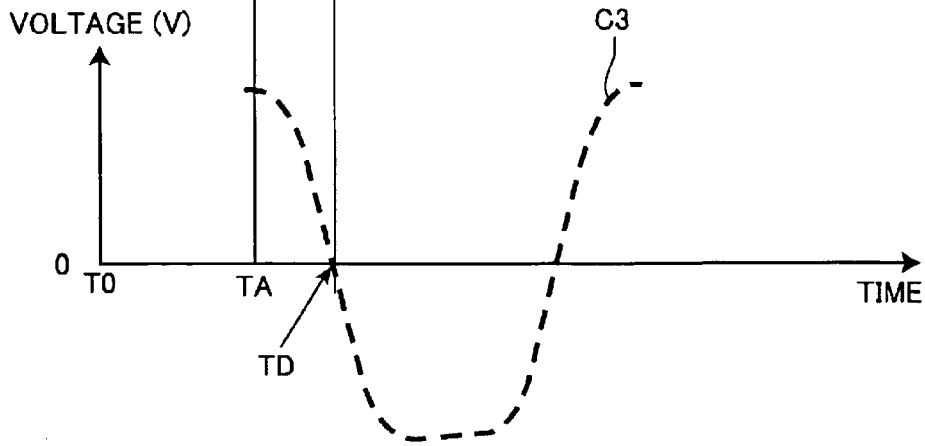

Next, a detecting method according to a second embodiment of the present invention will be described with reference to FIGS. 8 and 9. In this embodiment, patches 120 shown in FIG. 8 (only one patch 20 is shown in FIG. 8) are used. The patches 120 are wider than the light-detecting range of the sensor 21*a*, 21*b*, 21*c*, 21*d* in the sub-scanning direction Y. By forming each patch 120 wider than the width of the sensor 21*a*, 21*b*, 21*c*, 21*d*, a voltage of a detection signal from each sensor 21*a*, 21*b*, 21*c*, 21*d* levels off at a maximum value E as shown in FIGS. 9(*a*). Note that the detection signal reaches the maximum value E when the entire sensor 21*a*, 21*b*, 21*c*, 21*d* confronts the patch 120, and the timing at which the detection signal reaches a maximum value E has been known as a timing TA.

When detection starts, the waveform C1 of the detection signal from the sensor 21*a* is sequentially stored into the memory 32, and a voltage value at the timing TA is detected and stored into the memory 32 as the maximum value E.

Also at the timing TA, the CPU 31 starts outputting the waveform C1 from the memory 32, thereby producing a waveform C1' shown in FIG. 9(*b*) which is delayed a prescribed delay time from the waveform C1. The prescribed delay time equals to the time between the timing TO and the timing TA. Alternatively, the detection signal from the sensor 21*a* could be passed through a delay circuit (not shown) to produce the waveform C1'.

On the other hand, the waveform C2 of the detection signal from the sensor 21*b* is inverted by subtracting the waveform C2 from the maximum value E, which is stored in the memory 32 (voltage value of the detection signal from the sensor 21*b* is subtracted from the maximum value E), thereby obtaining an inverted waveform C2' shown in FIG. 9(*b*). Note that because the sensor 21*b* has the same sensing elements and construction as the sensor 21*a*, a maximum value of the detection signal from the sensor 21*b* is the same as the maximum value E of the detection signal from the sensor 21*a* as shown in FIG. 9(*a*).

The waveform C1' is superimposed on the waveform C2' by subtracting the waveform C1' from the waveform C2', thereby producing a waveform C3 shown in FIG. 9(*c*), and a timing TD at which the waveform C3 reaches zero is detected. The timing TD indicates a position of the patch 120. In this manner, the position of the patch 120 can be detected.

In this embodiment also, only the rising slopes of the waveforms C1 and C2 corresponding to the leading edge 120*a* of the patch 120 are used for detecting the position of the patch 120. Therefore, a highly precise position of the patch 120 can be detected at all times without a decline in position detection accuracy due to unstable behavior from defects and the like in the trailing edge 120*b* of the patch 120. Since the width of each patch 120 need not match the light-detecting range of the sensor 21*a*, 21*b*, 21*c*, 21*d*, it is possible to eliminate restrictions on the sensors 21*a*–21*d* that can affect precision, thereby improving the accuracy in position detection.

Note that the process for calculating the magnitude of misalignments of the patches 120 is the same as that described in the first embodiment.

Next, a detecting method according to a third embodiment of the present invention will be described with reference to FIGS. 10 and 11.

Figure 10:
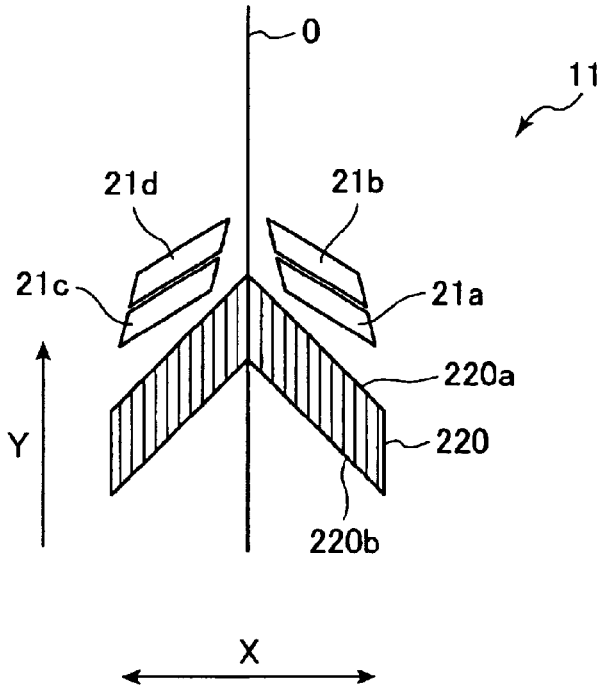
FIG. 10 is an explanatory diagram showing the positional relationship of a patch and the detection unit according to a third embodiment of the present invention.

FIG. 10 shows the positional relationship of patch 220 and the sensors 21*a*–21*d*. The patch 220 is formed wider in the sub-scanning direction Y than the width of each sensor 21*a*, 21*b*, 21*c*, 21*d*. Further, a leading edge 220*a* and a tailing edge 220*b* of the patch 220 are at a slightly different angle from the sensors 21*a*–21*d*.

Figure 11A:
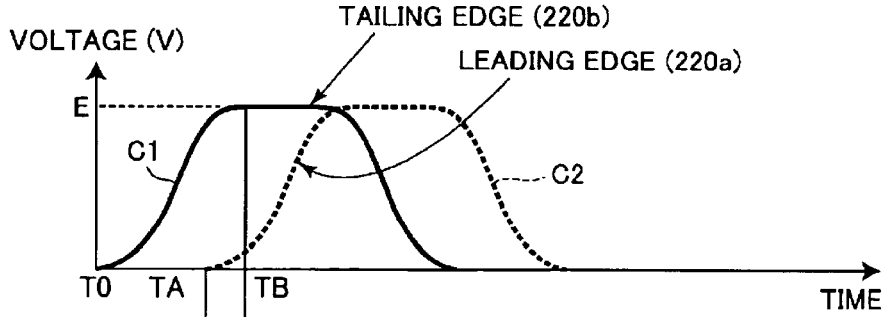
FIG. 11(*a*) shows waveforms of detection signals from the detection unit according to the third embodiment.
Figure 11B:
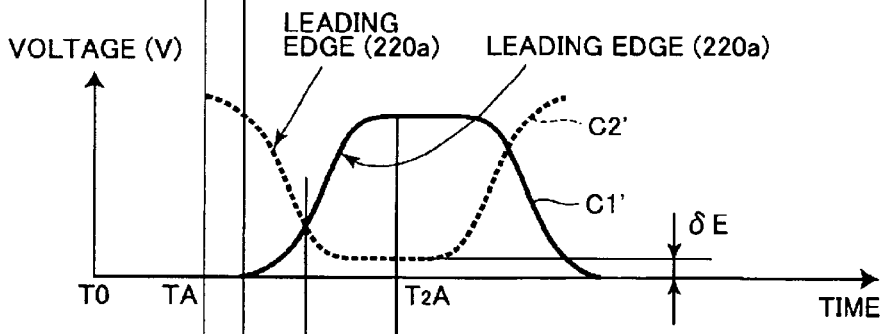
Figure 11C:
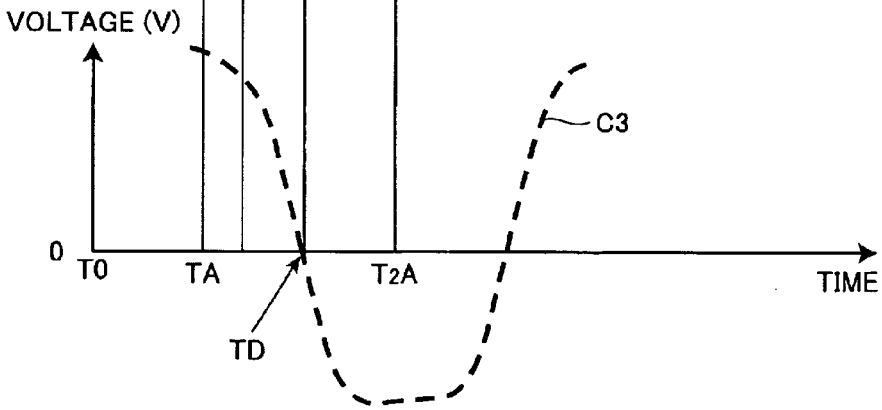

As shown in FIG. 11(*a*), by slightly offsetting the angles of the patch 220 and the sensors 21*a*, 21*b*, the sensor 21*b* starts outputting a detection signal at timing TB before a detection signal from the sensor 21*a* a reaches a maximum value E at timing TA.

In this embodiment, the maximum value of the waveform C1 and C2 is previously stored in the memory 32 for the following reason. That is, as mentioned above, the sensor 21*b* starts outputting the detection signal before the detection signal from the sensor 21*a* reaches the maximum value E. Therefore, if the maximum value E is detected from the waveform C1, then the waveform C2', which is generated by subtracting the waveform C2 from the value E, cannot be generated in time.

Here, the maximum value E to store into the memory 32 is obtained by measuring in advance a maximum value of a detection signal from the sensor 21*a*.

In the similar manner as in the second embodiment, the detection signal from the sensor 21*a* is outputted as a delayed waveform C1' shown in FIG. 11(*b*), and the detection signal from the sensor 21*b* is outputted as an inverted waveform C2' shown in FIG. 11(*b*). The waveform C1' is superimposed on the waveform C2' by subtracting the waveform C1' from the waveform C2', thereby generating a waveform C3. Then, by detecting a timing TD shown in FIG. 11(*c*) at which the waveform C3 reaches zero, the position of the patch 220 can be detected.

Since the maximum value E stored in the memory 32 is not an actually detected value, but is obtained in advance, it is inevitable that the prestored maximum value E differs from the actual maximum value of the waveform C2 by, for example, an error amount δE shown in FIG. 11(*b*). The error amount δE changes over time due to dust and the like adhering to the light-receiving unit in the sensor 21*b*. However, a single patch detection sequence does not require enough time for the error amount Eδ to change, the error amount δE stays constant. Therefore, the error amount Eδ does not affect the accuracy of detection.

Here, the region between the timings TA and T2A is a region at which the sensor 21*a* is detecting the leading edge 220*a* of the patch 220. If the timing TD does not occur between the timings TA and T2A, then this indicates that the error amount δE is too large, indicating that position detection is impossible. Accordingly, in the present embodiment, an error message is displayed and the detecting operation is halted when the position detection is determined impossible.

According to the third embodiment, a position of the patch 220 is detected based only on a portion of the waveform C3 that corresponds to the leading edge 220*a* of the patch 220, the position of the patch 220 can be detected accurately at all times regardless of unstable factors, such as defects and the like in the tailing edge 220*b* of the patch 220. Further, since the width of the patch 220 needs not match the width of the sensors 21*a*–21*d* and since the patch 220 and sensors 21*a*–21*d* need not be arranged parallel to one another, it is possible to reduce restrictions on the detecting system that can affect precision, thereby achieving a more accurate position detection.

According to the embodiments of the present invention, a position of the patch can be detected with high accuracy while suppressing a decline in detection accuracy over time, maintaining a high color registration precision and, hence, enabling high-quality recording operation without a decline in image quality.

While some exemplary embodiments of this invention have been described in detail, those skilled in the art will recognize that there are many possible modifications and variations which may be made in these exemplary embodiments while yet retaining many of the novel features and advantages of the invention.

For example, in the above embodiments, a timing at which the waveform C3 reaches zero is detected as a position of a patch. However, a timing at which a leading half of the waveform C1' crosses a front half of the waveform C2' can be detected as a position of a patch.

What is claimed is:

1. A detecting method for detecting a position of an image, comprising:

a) forming an image on a medium, the image having a leading edge facing a transport direction and a tailing edge opposite to the leading edge;

b) detecting the image on the medium using a detecting unit while transporting the medium in the transport direction relative to the detecting unit, the detecting unit outputting a detection signal, wherein the detection signal has a first portion corresponding to the leading edge of the image and a second portion corresponding to the tailing edge of the image; and c) detecting a position of the image based only on the first portion of the detection signal.

2. The detecting method according to claim 1, wherein: the first detecting unit includes a first detector and a second detector aligned in the conveying direction; in the step b), the first detector outputs a first detection signal, and the second detector outputs a second detection signal at a timing differing from an output timing of the first detection signal, wherein a first waveform of the first detection signal has a first portion corresponding to the leading edge of the image and a second portion corresponding to the tailing edge, and a second waveform of the second detection signal has a third portion corresponding to the leading edge of the image and a fourth portion corresponding to the tailing edge; and the step c) includes crossing the first portion of the first waveform and the third portion of the second waveform; and detecting the position of the image based on a position at which the first portion crosses the third portion.

3. The detecting method according to claim 1, wherein in the step b) the detecting unit outputs a first detection signal and a second detection signal at different timings, and the step c) includes reversing the first detection signal front-to-back, superimposing the reversed first detection signal on the second detection signal, thereby obtaining a superimposed waveform, and detecting the position of the image based on the superimposed waveform.

4. The detecting method according to claim 1, wherein in the step b) the detecting unit outputs a first detection signal and a second detection signal at different timings, and the step c) includes inverting the first detection signal top-to-bottom, superimposing the inverted first detection signal on the second detection signal, thereby obtaining a superimposed waveform, and detecting the position of the image based on the superimposed waveform.

5. The detecting method according to claim 1, wherein in the step b) the detecting unit outputs a first detection signal and a second detection signal at different timings, and the step c) includes delaying and reversing the first detection signal front-to-back, delaying the second detection, superimposing the delayed and reversed first detection signal on the delayed second detection signal, thereby obtaining a superimposed waveform, and detecting the position of the image based on the superimposed waveform.

6. The detecting method according to claim 1, wherein in the step b) the detecting unit outputs a first detection signal and a second detection signal at different timings, and the step c) includes delaying the first detection signal, inverting the second detection signal top-to-bottom, superimposing the delayed first detection signal on the inverted second detection signal, thereby obtaining a superimposed waveform, and detecting the position of the image based on the superimposed waveform.

7. The detecting method according to claim 6, wherein in the step of inverting the second detection signal, the second detection signal is inverted by subtracting a waveform of the second detection signal from a predetermined voltage value.

8. An electrophotographic recording device that forms multicolor images by superimposing a plurality of images in each of a plurality of colors one on the other, the electrophotographic recording device comprising:

a conveying unit that conveys a medium in a conveying direction;

an image forming unit that forms a predetermined test image on the medium;

a first detecting unit that detects the predetermined test image on the medium, the first detecting unit outputting a detection signal; and a second detecting unit that detects a position of the predetermined test image on the medium based on the detection signal from the first detecting unit, wherein the predetermined test image has a leading edge facing the conveying direction and a tailing edge opposite to the leading edge;

the detection signal includes a first portion corresponding to the leading edge and a second portion corresponding to the tailing edge; and the second detecting unit detects the position of the predetermined test image based only on the first portion of the detection signal.

9. The electrophotographic recording device according to claim 8, wherein the medium is a transfer belt that conveys a recording medium.

10. The electrophotographic recording device according to claim 8, wherein:

the first detecting unit includes a first detector and a second detector aligned in the conveying direction, the first detector detecting the predetermined test image and outputting a first detection signal, the second detector detecting the predetermined test image and outputting a second detection signal at a timing differing from an output timing of the first detection signal;

a first waveform of the first detection signal has a first portion corresponding to the leading edge of the predetermined test image and a second portion corresponding to the tailing edge, and a second waveform of the second detection signal has a third portion corresponding to the leading edge of the predetermined test image and a fourth portion corresponding to the tailing edge;

the second detecting unit crosses the first portion of the first waveform and the third portion of the second waveform and detects the position of the predetermined test image based on a position at which the first portion crosses the third portion.

11. The electrophotographic recording device according to claim 8, wherein the first detecting unit includes a first detector and a second detector aligned in the conveying direction, the first detector detecting the predetermined test image and outputting a first detection signal, the second detector detecting the predetermined test image and outputting a second detection signal at a timing differing from an output timing of the first detection signal; and the second detecting unit reverses the first detection signal front-to-back, superimposes the reversed first detection signal on the second detection signal, thereby obtaining a superimposed waveform, and detects the position of the predetermined test image based on the superimposed waveform.

12. The electrophotographic recording device according to claim 8, wherein the first detecting unit includes a first detector and a second detector aligned in the conveying direction, the first detector detecting the predetermined test image and outputting a first detection signal, the second detector detecting the predetermined test image and outputting a second detection signal at a timing differing from an output timing of the first detection signal; and the second detecting unit inverts the first detection signal top-to-bottom, superimposes the inverted first detection signal on the second detection signal, thereby obtaining a superimposed waveform, and detects the position of the predetermined test image based on the superimposed waveform.

13. The electrophotographic recording device according to claim 8, wherein the first detecting unit includes a first detector and a second detector aligned in the conveying direction, the first detector detecting the predetermined test image and outputting a first detection signal, the second detector detecting the predetermined test image and outputting a second detection signal at a timing differing from an output timing of the first detection signal; and the second detecting unit delays and reverses the first detection signal front-to-back, delays the second detection signal, superimposes the delayed and reversed first detection signal on the delayed second detection signal, thereby obtaining a superimposed waveform, and detects the position of the image based on the superimposed waveform.

14. The electrophotographic recording device according to claim 8, wherein the first detecting unit includes a first detector and a second detector aligned in the conveying direction, the first detector detecting the predetermined test image and outputting a first detection signal, the second detector detecting the predetermined test image and outputting a second detection signal at a timing differing from an output timing of the first detection signal; and the second detecting unit delays the first detection signal, inverts the second detection signal top-to-bottom, superimposes the delayed first detection signal on the inverted second detection signal, thereby obtaining a superimposed waveform, and detects the position of the image based on the superimposed waveform.

15. The electrophotographic recording device according to claim 8, wherein the first detection unit includes at least one sensor having a detection range that is smaller than a width of the predetermined test image with respect to the conveying direction.

16. The electrophotographic recording device according to claim 15, wherein the predetermined test image is in chevron shape having a leading edge facing the conveying direction, and the sensor is arranged in a direction not parallel to a direction of the leading edge of the predetermined test image.

17. The electrophotographic recording device according to claim 8, wherein the image forming unit includes a plurality of image forming devices each corresponding to one of the plurality of colors, and the predetermined test image includes a plurality of images in each of the plurality of colors.

* * * * *

UNITED STATES PATENT AND TRADEMARK OFFICE

CERTIFICATE OF CORRECTION

PATENT NO. : 6,993,275 B2
APPLICATION NO. : 10/796,208
DATED : January 31, 2006
INVENTOR(S) : Teruaki Mitsuya et al.

It is certified that error appears in the above-identified patent and that said Letters Patent is hereby corrected as shown below:

On the Title Page, Item [73], Assignees:
Insert -- Hitachi, Ltd., Tokyo (JP) -- as the second named Assignee, after "Ricoh Printing Systems, Ltd."

Signed and Sealed this

Twenty-ninth Day of January, 2008

JON W. DUDAS
*Director of the United States Patent and Trademark Office*